United States Patent [19]

Doerffer et al.

[11] 4,278,040

[45] Jul. 14, 1981

[54] BRAKING RUDDER DEVICE

[75] Inventors: Jerzy Doerffer, Sopot; Jerzy Madey, Gdańsk-Wrzeszcz; Jan Kozłowski, Gdańsk-Wrzeszcz; Andrzej Niepiekło, Gdańsk-Wrzeszcz, all of Poland

[73] Assignee: Politechnika Gdanska, Gdańsk, Poland

[21] Appl. No.: 37,566

[22] Filed: May 9, 1979

[30] Foreign Application Priority Data

May 10, 1978 [PL] Poland ..... 206679

[51] Int. Cl.[3] ..... B63H 25/34

[52] U.S. Cl. ..... 114/170; 114/145 R

[58] Field of Search ..... 440/39.43; 114/145 R, 114/145 A, 170

[56] References Cited

U.S. PATENT DOCUMENTS

| | | | |
|---|---|---|---|
| 496,700 | 5/1893 | Samohod | 114/145 R |
| 793,746 | 7/1905 | Smethurst | 114/145 R |
| 947,833 | 2/1910 | Lund | 114/145 R |
| 1,257,165 | 2/1918 | Westendarp | 114/145 R |
| 1,574,718 | 2/1926 | Westendarp | 114/145 R |
| 2,544,642 | 3/1951 | Abbott | 114/145 R |
| 3,561,392 | 2/1971 | Baez | 115/12 R |

FOREIGN PATENT DOCUMENTS

| | | | |
|---|---|---|---|
| 422938 | 1/1935 | United Kingdom | 114/145 R |

OTHER PUBLICATIONS

Schiff and Hefen (German Publication) Heft 4/74, 26 Jahrgang.

*Primary Examiner*—George E. A. Halvosa
*Attorney, Agent, or Firm*—Ladas & Parry

[57] ABSTRACT

This invention relates to braking rudder device consisting of turning rudder blade, horizontal plates and fixed rudder post, which is characterized by dividing the rudder blade in plane of symmetry in two blades, which are turning independently by an angle up to 110° around their common axis where they are connected hingewise and their trailing edge is in the form of a wedge, while each of the blades are stiffened by horizontal plates which in extreme outboard position are bearing upon the rudder post and along the trailing edges are fitted vertical flaps capable of turning by an angle up to 90°.

2 Claims, 3 Drawing Figures

A-A

A-A

BRAKING RUDDER DEVICE

The present invention relates to a braking rudder device for ships with no navigation limits, particularly for large ships.

Rudders of unconventional blade cross section and with horizontal guide plates situated above and below propeller race are already known. As example may serve here the rudders of Käufer and Schilling, published in a monthly "Schiff und Hafen" Heft 4/74, 26 Jahrgang. They are enabling, especially with twin arrangement, the redirection of propeller race and the controlled astern movement of the ship without reversing the propeller. From the same publication Bröhl's rudder is known, which on the leading and trailing edges has hinged flaps that are forming a shield, which in its extreme position redirects the propeller race.

These arrangements may serve for braking ships in a similar manner as the arrangements consisting of two or three balanced rudders with almost flat cross sections which after turning, are touching each other forming a concave shield according to the design "Turbinia" by Parsons, which is known from the publication Sir Charles Parsons and the Naval Architect page 14.

The disadvantage of the above arrangements is a very low effectiveness of braking, when they are being used for steering, while braking. They are fully effective only with a twin rudder arrangement, that is met only on some types of ships and rather seldom on large sea going vessels.

The aim of the invention is to improve the manoeuvring abilities of the ship and to simplify its main power installation by eliminating the reversing gear. It gives the possibility of auxiliary steering the ship.

According to the present invention, there is provided a braking rudder device which consists of a turning blade horizontal plates and a fixed rudder post. The rudder blade is divided in the plane of symmetry into two blades which can be independently turned by an angle up to 110° to the side around their common axis. These two separate blades are joined hingewise round their front edge, whereas the trailing edge is wedge profiled and each of the blades at the top and at the bottom has horizontal plates, which at the extreme outboard position are bearing against the rudder post. Horizontal plates may be placed also in line with propeller axis.

One of the blades is fixed to the solid rudder stock, whereas the other blade is fixed to a hollow rudder stock, in which the solid rudder stock is housed. Both rudder stocks are transmitting jointly or individually the turning moment from the steering gears.

In one preferred embodiment braking rudder device, consists of a turning blade and a fixed rudder post, where the rudder blade is divided in the plane of symmetry into two blades, which can be independently turned by an angle up to 110° to the side around their common axis. These two separate blades are joined hingewise round their front edge, whereas their trailing edge is wedge profiled and each of the blades at the top and at the bottom as well as in the line with the propeller axis has horizontal plates, that at the extreme outboard position are bearing against the rudder post. On the trailing edges vertical hinged flaps are fitted, which are forming an elongation of the closed rudder blade. Hinged vertical flaps on this blade trailing edges could be independently turned sideways by an angle from 0° to 90°.

One of the blades is fixed to the solid rudder stock, whereas the other blade is fixed to a hollow rudder stock, in which the solid rudder stock is housed. Both rudder stocks are transmitting jointly or individually the turning moment from the steering gears.

The rudder blades in their extreme outboard position form a substantially concave braking shield, that is redirecting the propeller race forward, thus an effective braking action is obtained without reversing the propeller or changing the pitch of propeller blades.

Model tests carried out with this device clearly indicate the interdependence between the optimum angle of turn of the rudder blades and the speed of the ship, what is indicating the necessity of control of this angle during braking the ship. The model tests have also shown that the normal distance of the rudder from the propeller is an optimum from the braking point of view and there is no need of placing the rudder further aft, because it increases the vibrations and lowers its effectiveness.

The advantages resulting from the application of the device according to the present invention consist: in utilising the rudder normally fitted on every ship for braking purposes and especially a rudder situated in line of propeller race and fitted with a fixed rudder post. Thus its weight is limited and the number of additional outfit is limited to a few details situated inside normal arrangements and thus protected from any damage. The control of turning angle of blades allows steering the ship during braking the ship or during manoeuvring with very low or zero speeds, whereas the braking effect or side thrust is obtained without reversing the propeller or changing the pitch of propeller blades.

The rudder according to present invention is safeguarding improved manoeuvering characteristics of the ship due to bigger angle of turn than with typical rudders.

Embodiments of the present invention will now be described by way of example with reference to the accompanying drawings in which.

Figure 1:
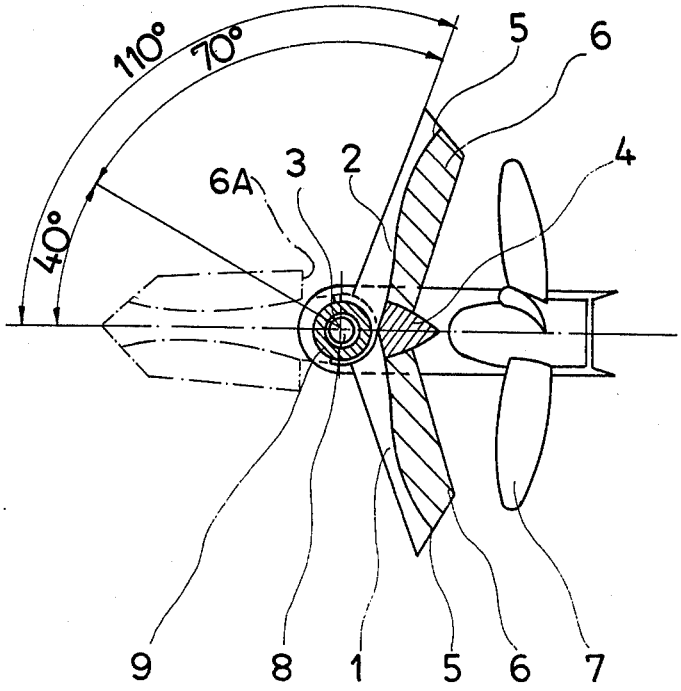
FIG. 1 shows in solid lines a cross-section in plane A—A /FIG. 2/ of the braking rudder device in opened condition and in broken lines the device in closed position.
Figure 2:
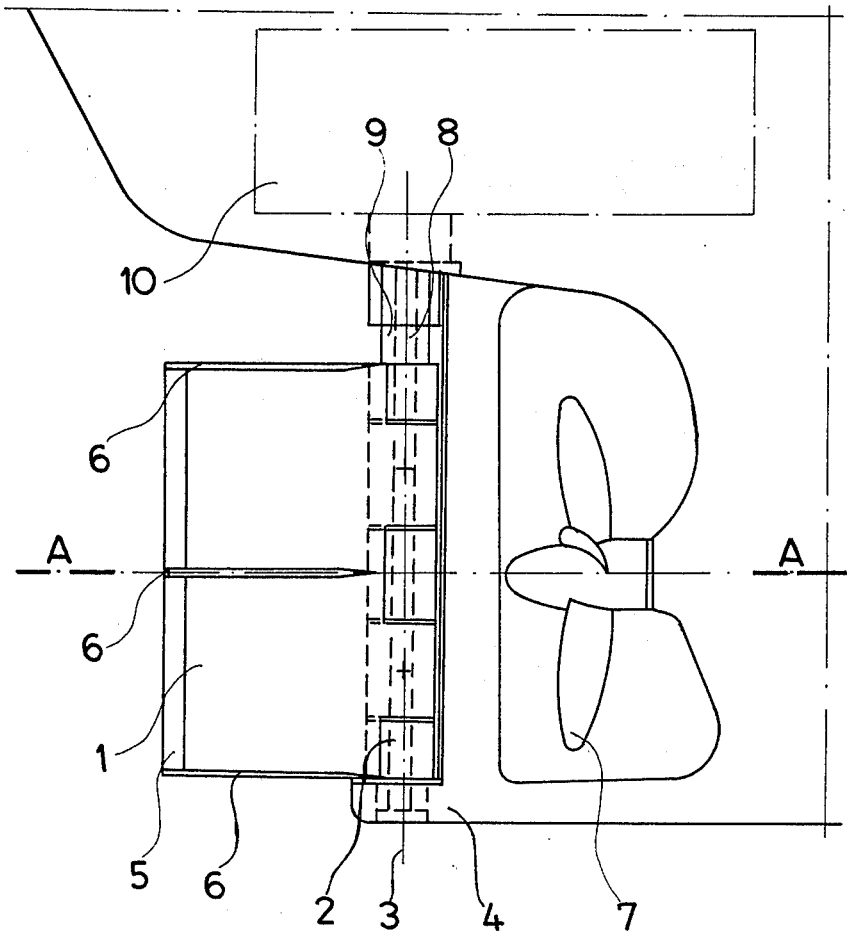
FIG. 2 shows the side view of the device.

FIGS. 1 and 2 show the device consisting of a turning rudder blade, divided in plane of symmetry into blades 1 and 2 independently which can be turned from a closed position to an open position up to 110° around the common vertical axis 3 fastened to a stern frame vertical post 4.

Both blades 1 and 2 have substantially concave forwardly facing surfaces, in said open position, and are joined together by means of a hinge in their forward part and their trailing edges are wedge shaped 5. Each of the blades has at the top and at the bottom horizontal plates 6 and one horizontal center plate in line with propeller axis 7, each plate having a leading edge 6A which in extreme outboard position abut against the rudder post 4, which is the leading edge of the device. The post is tapered in cross section perpendicular to the vertical axis 3.

Rudder blade 1 is blocked with the solid rudder stock 8 and blade 2 with the hollow rudder stock 9 housing the solid rudder stock 8. Rudder stocks 8 and 9 can jointly or independently transmit the turning moment from the steering gears 10.

Figure 3:
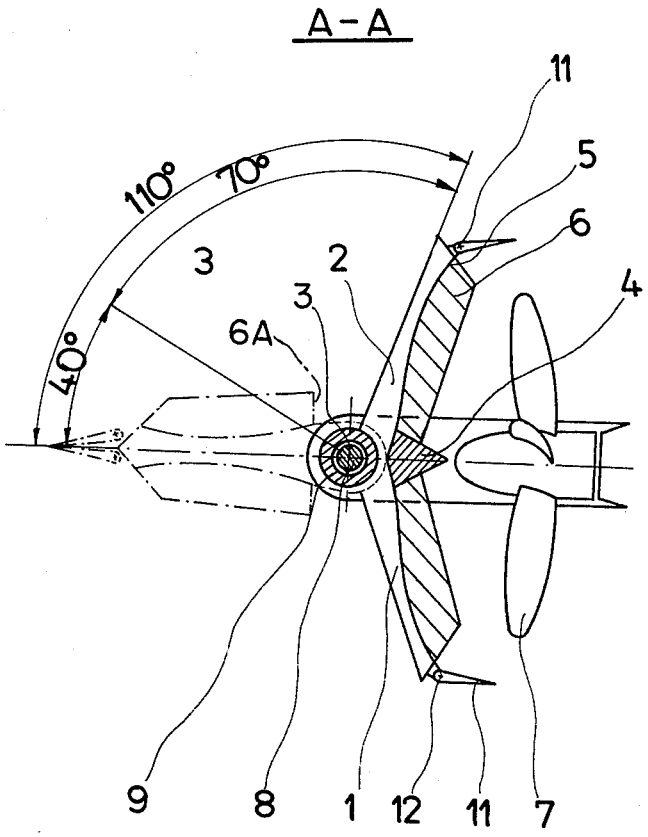
FIG. 3 shows in solid lines a cross-section in plane A—A /FIG. 2/ of an alternate rudder braking device similar to FIG. 1 with vertical trailing edge flaps in opened condition and in broken lines the device in closed position.

In the device shown in FIG. 3 vertical trailing edge flaps 11 are fitted by means of hinges. These flaps with closed blades are forming a rudder blade capable of turning to both port and starboard by an angle up to 40°. The trailing edge flaps 11 can turn to the sides preferably independently of each other by an angle up to 90° by means of hydraulic hinges 12 attached to the wedge shaped trailing edges.

The braking rudder device may be used in following situations:

"crash stopping" with full course control during braking process;

side thrusting the stern without forward movement;

very slow forward movement with manoeuvering.

While "crash stopping" the rudder blade has to be placed in plane of symmetry and the steering gears 10 have to be switched over from conventional steering to individual operation of each blade 1 and 2 independently, including the vertical trailing edge flaps 11. At first the blades opened symmetrically to maximum angle and only then depending from the action of waves, wind and propeller moment an appropriate correction in opening angle of blades 1 and 2 and vertical trailing edge flaps 11 has to be introduced to create side thrust steering forces.

To finish the manoeuvre the blades 1 and 2 are closed, the vertical trailing edge flaps 11 placed in the plane of symmetry and the steering gears 10 are switched over to conventional steering. The speed of the propeller 7 might be slightly lowered in order not to allow the main engine to be overloaded.

In side thrusting the stern the rudder blades 1 and 2 are opened unsymmetrically as well as the vertical trailing edge flaps 11 and only then the propeller 7 is allowed to start with such a speed as to obtain a side thrust only from the redirected propeller race. The speed of the propeller 7 might be increased and the angles of opening of blades 1 and 2 as well as of flaps 11 altered according to the movement of the stern.

In the situation of very slow movement forward, the blades 1 and 2 are opened symmetrically to an intermediate angle i.e. 50° to 60° and the speed of movement of the ship and its direction is controlled by changes in angle of opening the blades 1 and 2 as well as of vertical trailing edge flaps 11.

In the situation when an increased manoeuvrability of the ship is required, the rudder could be turned to an angle greater than 40°, thus obtaining greater side force.

What we claim is:

1. A braking rudder device comprising a pair of hinged members to be pivoted about a common vertical axis behind the propeller of a vessel, each hinged rudder member being independently rotatable from a first position lying in a vertical plane of symmetry and rotatable independently and oppositely outwardly from said plane to a second position through an angle of 110° about said common vertical axis, each said member having a concave forwardly facing surface in said second position, said hinged members being supported for said pivotal movement about said common vertical axis which is located at the leading edge of said rudder members, a vertical post positioned immediately forward of said axis and having a tapered profile in cross-section perpendicular to said common vertical axis and defining the leading edge of said rudder device, support means for each hinged member comprising first reinforcing plates horizontally disposed along the top edge of each hinged member, second horizontal reinforcing plates positioned along the bottom edge of each hinged member and third horizontal reinforcing plates secured to each hinged rudder member in a horizontal plane and coaxial with said propeller when said hinged members are disposed adjacent to each other in said first position, each of said horizontal plates extending forwardly of the concave surface of each corresponding hinged member in said second position, and a pair of vertically elongated rotational control members mounted concentrically with respect to each other and coaxially with respect to said vertical axis, and adapted for independent transmission of turning forces to each hinged member, respectively.

2. A braking rudder device according to claim 1, wherein the trailing edges of each hinged member and its reinforcing plates are tapered rearwardly with reference to said vertical axis, and wherein said plates are provided with leading edges which are adapted to abut said vertical post when said hinged members are pivoted to said second position, and wherein a pair of vertically mounted trailing edge flap means are positioned along said trailing edges, said flap means being independently pivoted about said vertical trailing edges through an angle up to 90° degrees.

* * * * *